United States Patent [19]

Kihara et al.

[11] Patent Number: 5,018,071

[45] Date of Patent: May 21, 1991

[54] METHOD AND APPARATUS FOR CONTROLLING A GRINDER HAVING A SPINDLE WITH DEFLECTION SENSOR

[75] Inventors: Hiroyuki Kihara; Hideki Omori, both of Narashino, Japan

[73] Assignee: Seiko Seiki Kabushiki Kaisha, Japan

[21] Appl. No.: 276,229

[22] Filed: Nov. 23, 1988

[30] Foreign Application Priority Data

Dec. 1, 1987 [JP] Japan ..... 62-183625[U]
Dec. 1, 1987 [JP] Japan ..... 62-304222
Aug. 23, 1988 [JP] Japan ..... 63-208796

[51] Int. Cl.[5] ..... G05B 19/18
[52] U.S. Cl. ..... 364/474.17; 51/165.71
[58] Field of Search ..... 364/474.06, 474.17, 364/167.01; 318/567; 51/165.71

[56] References Cited

U.S. PATENT DOCUMENTS 4,586,146 4/1986 Dumbock ..... 364/474.06
4,590,573 5/1986 Hahn ..... 364/474.06
4,603,392 7/1986 Chikamoto ..... 364/474.06
4,667,445 5/1987 Kimura ..... 364/474.17
4,709,509 12/1987 Yoneda et al. ..... 364/474.06
4,790,697 12/1988 Hines et al. ..... 364/474.17
4,791,575 12/1988 Watts ..... 364/474.06
4,855,925 8/1989 Bhateja ..... 364/474.06

*Primary Examiner*—Allen R. MacDonald
*Attorney, Agent, or Firm*—Bruce L. Adams; Van C. Wilks

[57] ABSTRACT

A grinder with a deflection sensor for controlling the grinding work conditions based on an amount of deflection of a grinding shaft occurring in the normal direction relative to the grinding shaft which is detected by measuring inductance with the deflection sensor. Based on a deflection of the grinding shaft detected during grinding work, the feed of the grinder is controlled, and the sharpness of the grinder is determined based on changes of the detected deflection amount during spark-out, moreover an error in the signal from the deflection detector caused by a thermal change can be compensated, whereby grinding work is carried out under an optimum condition, and the grinding accuracy and efficiency are improved.

11 Claims, 7 Drawing Sheets

$\delta$ = DEFLECTION AMOUNT OF GRINDER GRINDING

METHOD AND APPARATUS FOR CONTROLLING A GRINDER HAVING A SPINDLE WITH DEFLECTION SENSOR

BACKGROUND OF THE INVENTION

1. Field of the Invention

The present invention relates to a method and apparatus for controlling a grinder having a spindle with a deflection sensor and a signal temperature-compensation function of the deflection sensor output.

2. Description of the Prior Art

A grinding apparatus in the prior art has simply a set of fixed points of adjusting the cutting condition, because all of the working conditions such as rough grinding, fine grinding, finishing grinding, etc., are determined based on the change of measurements of a workpiece.

However, in this case, it is not possible to grind a workpiece under an optimum grinding condition taking into account a variation of the cutting efficiency of a grinder. Because of this, it is not possible to improve beyond a certain level, the grinding accuracy which is measured in terms of circularity, cylindricality, surface roughness, etc., and the grinding work efficiency.

There is another grinder in which the cutting amount is controlled in response to an electric power consumed for grinding work by the grinding shaft. In this apparatus, a force component of the grinding resistance acting in the tangential direction relative to the grinding shaft (in a direction perpendicular to the cutting direction) is indirectly detected, and thereby the cutting speed is controlled and the cutting condition is changed.

However, in this case, a tangential force component of the grinding resistance is detected, notwithstanding detection of a normal force component of the grinding resistance which is said to be the most favorable way to determine the cutting efficiency of a grinder, and therefore it is not possible to sufficiently detect changes of the cutting efficiency of the grinder and thus it is difficult to control the grinding condition at its optimum.

SUMMARY OF THE INVENTION

An object of the present invention is to improve the accuracy and efficiency of a grinding apparatus having a spindle apparatus with deflection sensor means by controlling the grinding work conditions based on an amount of deflection of a grinding shaft occurring in the normal direction relative to the grinding shaft which is detected by the spindle apparatus with deflection sensor means.

Another object of the present invention is to provide a method for controlling a grinder having a spindle with a deflection sensor wherein grinding conditions, grinding spark-out conditions and grinding wheel dressing timing are detected by monitoring deflection amounts of the grinding shaft.

A further object of the present invention is to provide signal error correction means of a spindle apparatus to compensate for an error in a signal from the deflection sensor means which is caused by a change in temperature, and thereby properly adjusting the machining condition with a correct signal.

In order to solve the problems accompanying a grinder having a spindle with a grinding shaft and a grinding wheel mounted at its one end, and deflection sensor means for detecting the amount of deflection of said grinding shaft at said one end thereof caused by tangential and normal force components of the grinding resistance acting against a workpiece, the present invention provides a method and apparatus for controlling a grinding apparatus having a spindle apparatus with deflection sensor means for adjusting the working conditions and determining the time of correction of a tool (dressing) in response to signals transmitted from deflection sensor means.

The deflection sensor means detects a deflection of a grinding shaft at the end portion thereof caused by a force component of the grinding load acting against a workpiece in the normal direction (in the cutting direction) relative to the grinder, and the grinding condition is adjusted based on the detected amount of the deflection. Because of this feature, the cutting efficiency of the grinder is precisely determined, grinding work is carried out under an optimum grinding condition taking into account a variation of the cutting efficiency, and the grinding accuracy and efficiency are improved.

Moreover, the output signal from the deflection sensor means can be corrected to indicate accurate information by a signal temperature-compensation function having temperature sensor means, and therefore an initial machining condition is properly adjusted.

DETAILED DESCRIPTION OF THE PREFERRED EMBODIMENTS

The present invention is hereunder described with reference to the accompanying drawings.

Figure 7:
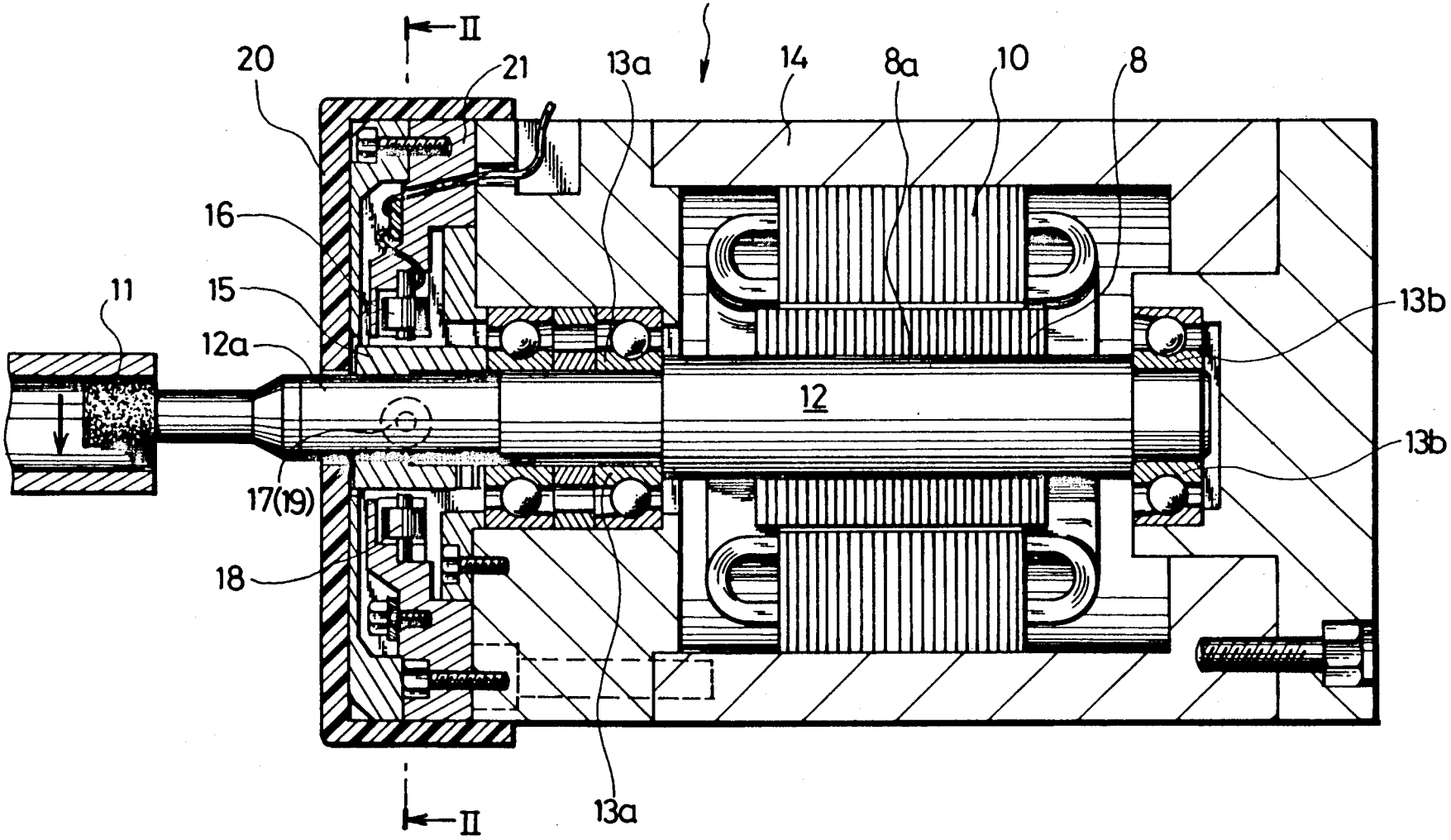
FIG. 7 shows a spindle apparatus of a grinder used in an embodiment of the present invention.
Figure 8:
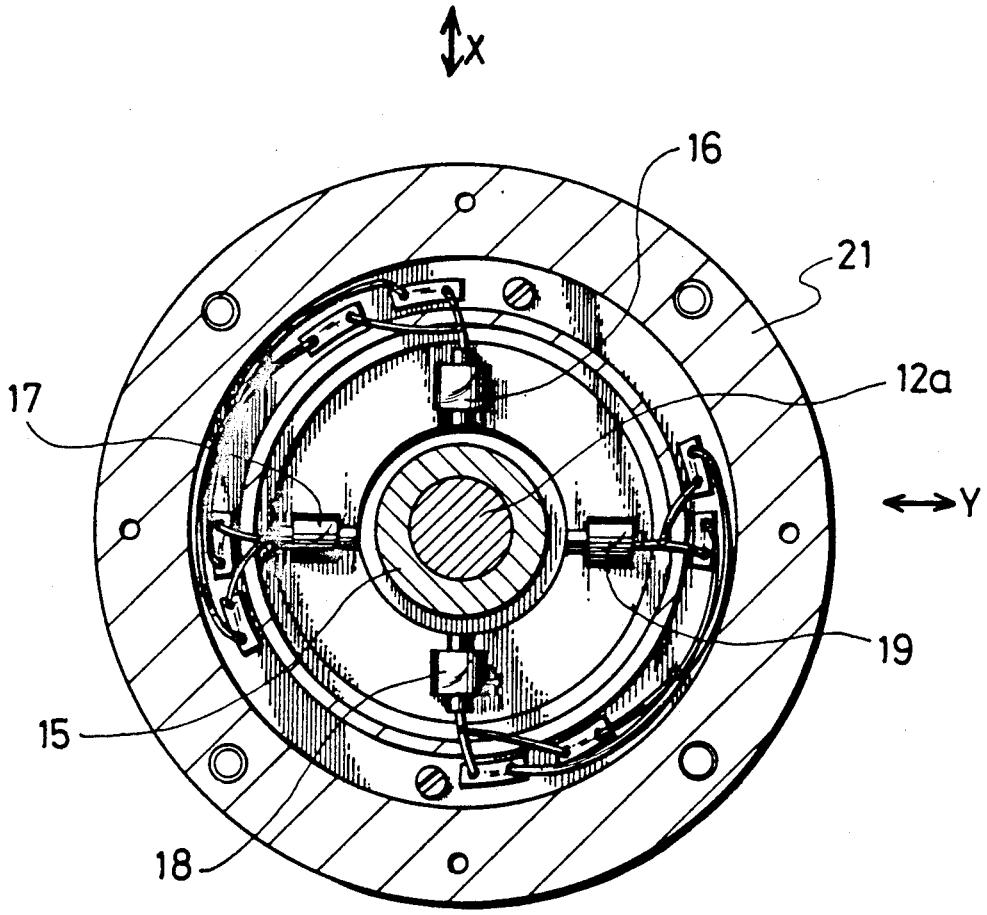
FIG. 8 is a sectional view taken on the line II—II shown in FIG. 7.

FIG. 7 and FIG. 8 show a spindle apparatus with deflection sensor means to be used for the present invention. As shown in FIG. 7 a high-frequency motor 10 is provided around the central portion of the length of a spindle apparatus 5. The high-frequency motor 10 has a rotor 8 with a through-hole 8*a* provided at the radial center thereof. A grinding shaft 12 is provided with a grinding wheel 11 at an end portion thereof 12*a* for grinding a workpiece shown on the left hand side in the figure. The grinding shaft 12 is firmly spliced within the through-hole 8*a* of the rotor 8, and they rotate together.

The high-frequency motor 10 is provided within a casing 14 forming the outer surface of the spindle apparatus 5. Both ends of the grinding shaft 12 are supported at both ends of the casing 14 through bearings 13*a* and 13*b*. A sensor holder 21 is provided in the casing 14 on the side of the workpiece, and sensors 16–19 (deflection sensor means) are disposed on the sensor holder 21 at the side of the grinding shaft 12 as shown in FIG. 8.

Each of the sensors 16–19 detects a gap between itself and the outer peripheral surface of a cylindrical target 15 which is fixed around the outer peripheral surface of the end portion 12*a* of the grinding shaft 12, and thereby detects deflection at the end portion 12*a* of the grinding shaft 12 occurring in the radial direction, particularly the normal direction (the cutting direction of the grinding wheel 11, i.e., the direction X as shown in FIG. 8), and in the tangential direction of the grinding shaft 12.

A shielding member 20 formed with a heat insulating material such as bakelite, etc. is provided on and closer to the workpiece side of the sensor holder 21. It prevents grinding fluid from splashing from the workpiece side onto the sensors 16–19 and the sensor holder 21 so that the sensor function is not considerably harmed.

Each of the sensors 16–19 is comprised of a copper wire wound around an iron core, and detects a change of the inductance caused by a change of the gap between the tip of the iron core and the outer peripheral surface of the target 15, and thereby detects a deflection (displacement) at the end portion 12*a* of the grinding shaft 12 in its radial direction.

In the spindle apparatus 5 as described hereabove, the grinding shaft 12 is rotated at high speed by the high-frequency motor 10, and the grinding wheel 11 grinds the internal surface of the workpiece. At the same time, the sensors 16–19 detect a deflection at the end portion 12*a* of the grinding shaft 12 which is caused by a grinding force. Based on the detected deflection amount of the spindle 12, the cutting speed and cutting amount are controlled, and an optimum moment for correction of the tool (dressing) is determined, whereby grinding work under an optimum condition is effected.

Figure 1:
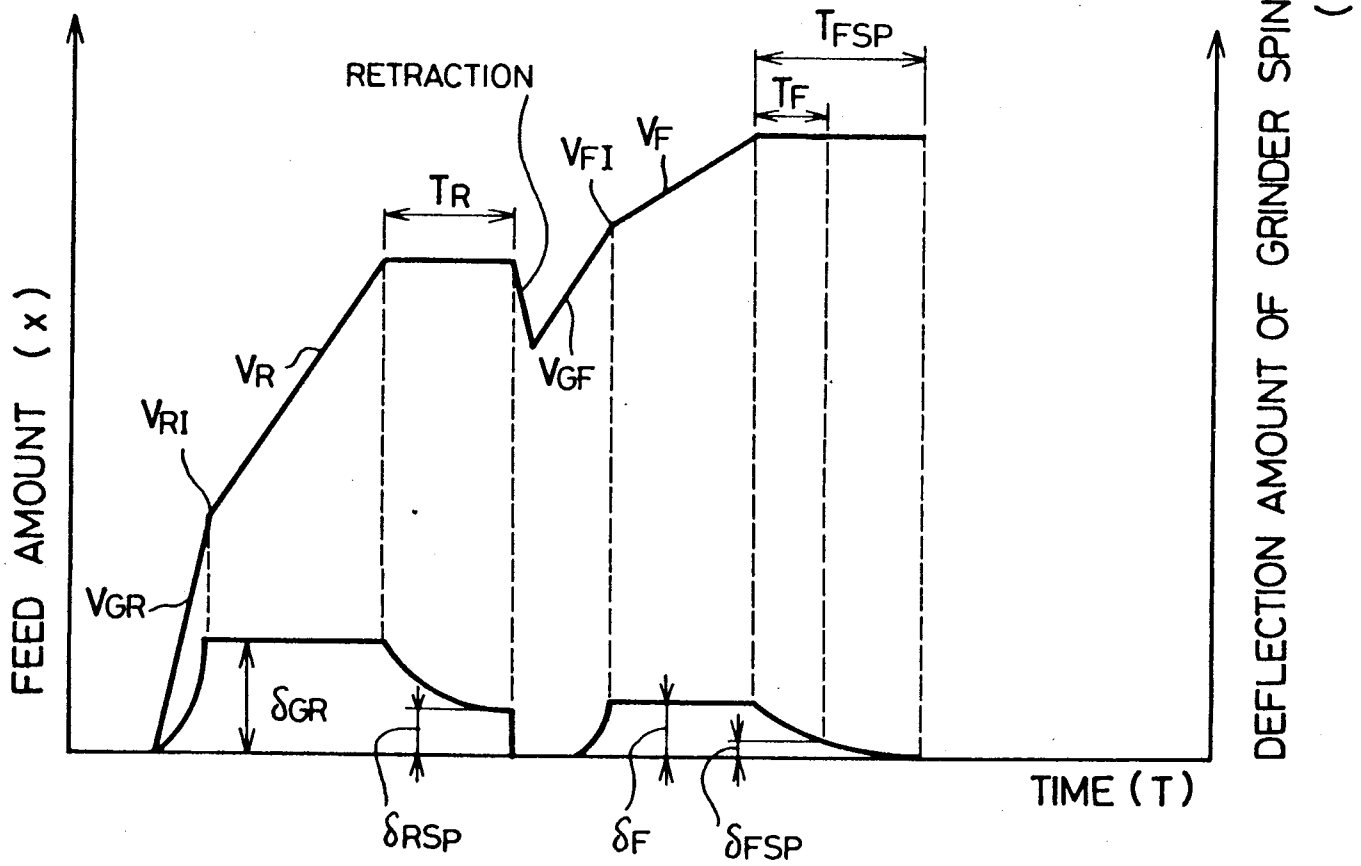
FIG. 1 is a diagram showing the relationship between the feed amount of the grinder and deflection amount of the grinding shaft, versus the machining time in an embodiment of the present invention.
Figure 2:
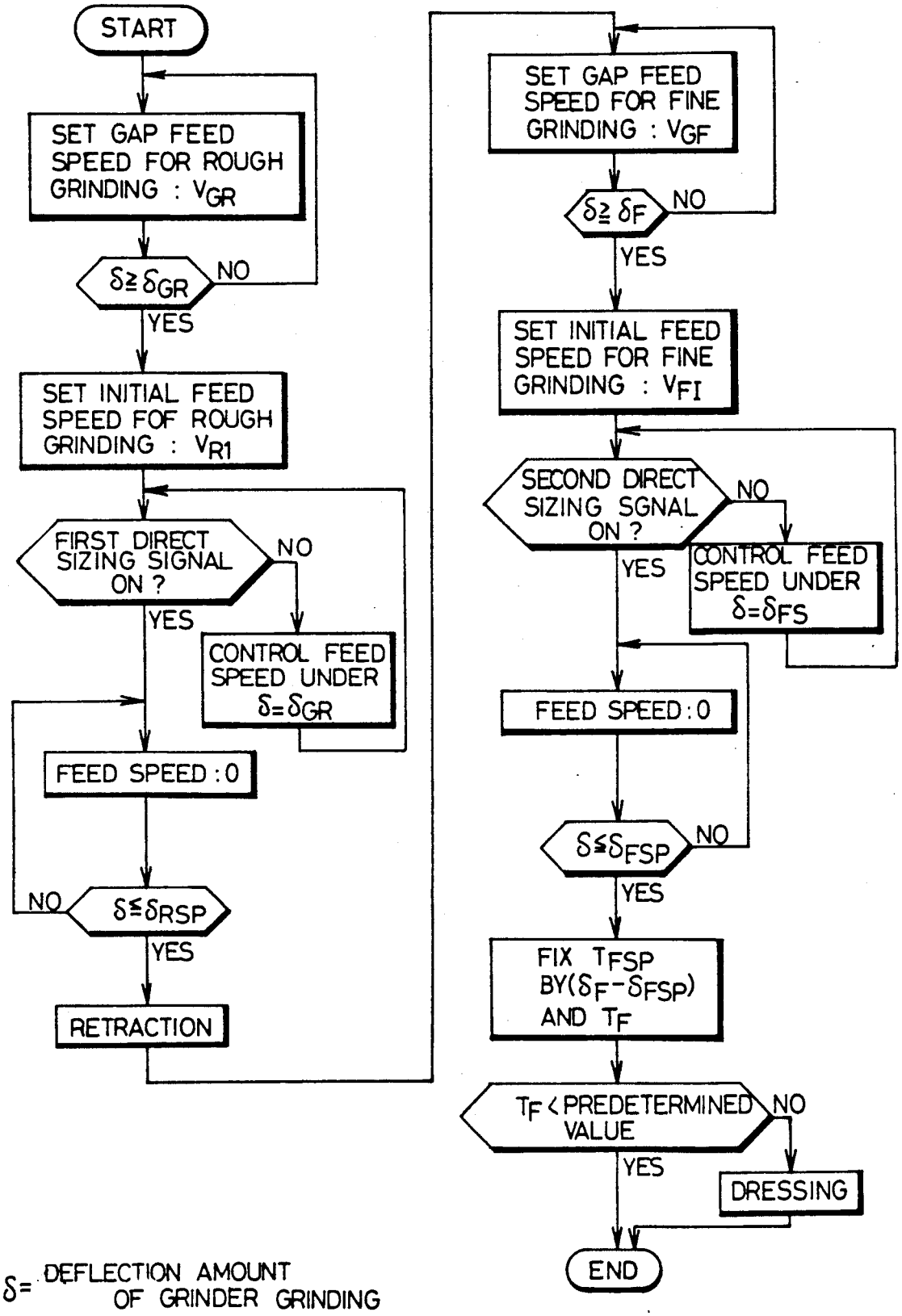
FIG. 2 is a control flow chart of an embodiment of the present invention.
Figure 3:
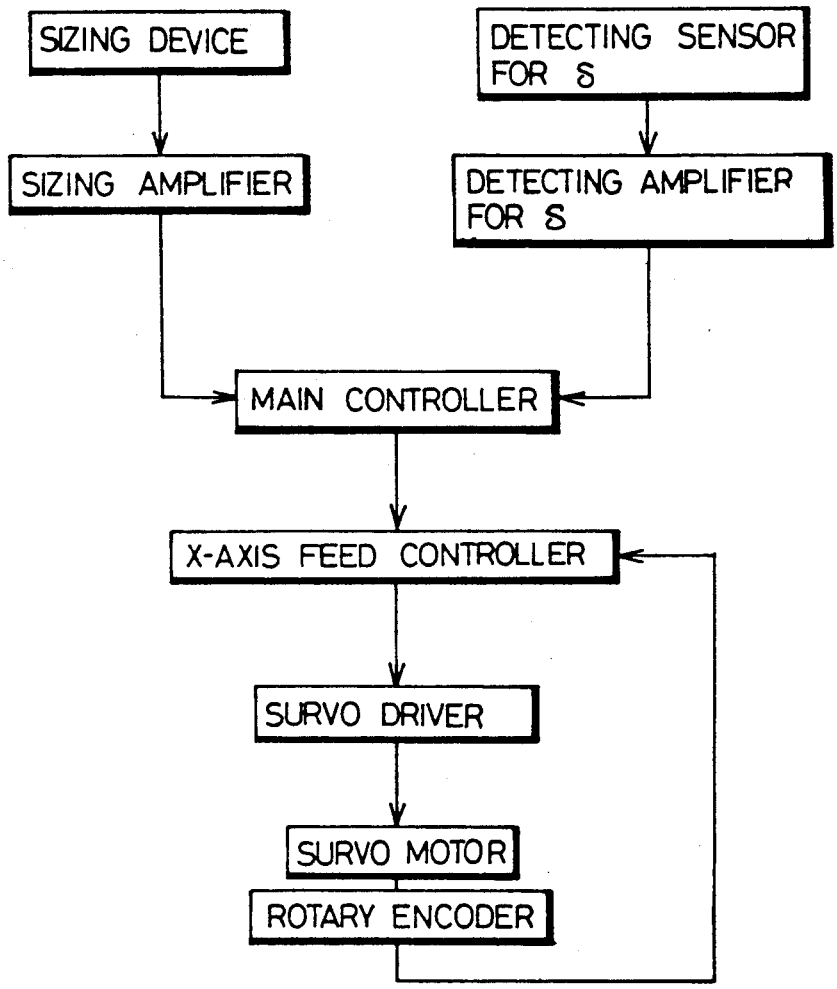
FIG. 3 is a control block diagram of an apparatus used in an embodiment of the present invention.

The details of the control in connection with FIG. 1–FIG. 3 is hereunder described with reference to a block diagram shown in FIG. 3. A deflection at the end portion of the grinding shaft is detected by the detecting sensors. Signals detected by the sensors and a sizing device are inputted into a main controller, and a servo motor is controlled by a control block comprising the main controller, an X-axis feed controller, a survodriver and a rotary encoder, whereby the feed of the grinder is controlled.

A grinding process is described with reference to FIG. 1 and FIG. 2.

The grinding shaft 12 is rotated by the high-frequency motor together with the grinding wheel 11. The grinding wheel 11 is fed from a position at which it is not in contact with a workpiece, at a gap feed speed for rough grinding $V_{GR}$. When the grinding wheel 11 touches the workpiece, and is further fed, the end portion 12*a* of the grinding shaft 12 starts deflecting. A deflection of the grinding shaft, i.e., a deflection $\delta$ at the end portion 12*a* of the grinding shaft 12 in the normal direction (cutting direction) relative to the grinding shaft 12 is detected by the sensors 16 and 18. A detection signal corresponding to the deflection amount $\delta$ is transmitted to the main controller through a grinding shaft deflection detection amplifier. When the deflection amount $\delta$ becomes $\delta_{GR}$, the control block comprising the main controller, the x-axis feed controller, the servo driver and the rotary encoder controls and changes the gap feed speed for rough grinding to an initial rough grinding feed speed $V_{RI}$.

A rough grinding feed speed $V_R$, after the feed speed is changed to the initial rough grinding feed speed $V_{RI}$, is controlled so that a deflection at the end portion 12*a* of the grinding shaft 12 in the normal direction thereof becomes constant at $\delta_{GR}$. Therefore the rough grinding feed speed $V_R$ is not constant.

When the workpiece is ground to a predetermined size, the sizing device, which detects changes of the size of the workpiece during grinding, outputs a first sizing signal to the main controller through a sizing amplifier, whereby the rough grinding is completed and a rough grinding spark-out is started.

The time for the rough grinding spark-out $T_R$ continues until a deflection $\delta$ at the end portion 12*a* of the grinding shaft 12 in the normal direction thereof becomes $\delta_{RSP}$, the grinding wheel 11 is temporarily retracted and is separated from the workpiece. Then the grinding wheel 11 is fed at the gap feed speed for fine grinding $V_{GF}$. When the grinding wheel 11 touches the workpiece again, and the grinding wheel 11 is further fed, the end portion 12*a* of the grinding shaft 12 starts deflecting.

The deflection $\delta$ in the normal direction is detected by the sensors 16 and 18, and the detected signal is inputted into the main controller. The gap feed speed for fine grinding $V_{GF}$ is changed to an initial feed speed for fine grinding $V_{FI}$ in response to a detected signal outputted when the deflection amount $\delta$ becomes $\delta_F$.

After the feed speed is changed to the initial feed speed for fine grinding $V_{FI}$, the feed speed for fine grinding $V_F$ is controlled so that the deflection $\delta$ at the end portion 12*a* of the grinding shaft 12 in the normal direction thereof is constant at $\delta_F$. Therefore the feed speed for fine grinding $V_F$ is not constant.

When the workpiece is ground to a second predetermined size, the sizing device outputs a second sizing signal to the main controller through the sizing amplifier, whereby the feed for fine grinding is stopped, and a spark-out of fine grinding is started.

The time for spark-out for fine grinding $T_{FSP}$ is calculated by, for example $T_F \times \delta_F/(\delta_F - \delta_{FSP})$, based on the time $T_F$ which is required for the transition of the deflection $\delta$ at the end portion 12*a* of the grinding shaft 12 in the normal direction thereof from $\delta_F$ and $\delta_{FSP}$.

When the time $T_{FSP}$ passes, the fine grinding step completes, and the grinding wheel 11 is separated from the workpiece. The control block measures time $T_F$ which is required for the transition of the deflection $\delta$ detected by sensors 16 and 18 from $\delta_F$ to $\delta_{FSP}$ after the spark-out for fine grinding is started. The time $T_F$ is used to determine the sharpness of the grinding wheel 11. When it exceeds a predetermined value, it is determined that the sharpness of the grinder has deteriorated, and a command for the dressing is outputted.

Based on the deflection amount in the normal direction of the grinding shaft 12 and in the manner as described hereabove, the feed speed and cutting amount are controlled, and the command for correction of the tool is outputted, whereby the sharpness of the grinding wheel 11 is always maintained, a workpiece can be ground under an optimum condition, and therefore the grinding accuracy and efficiency are improved.

Figure 4:
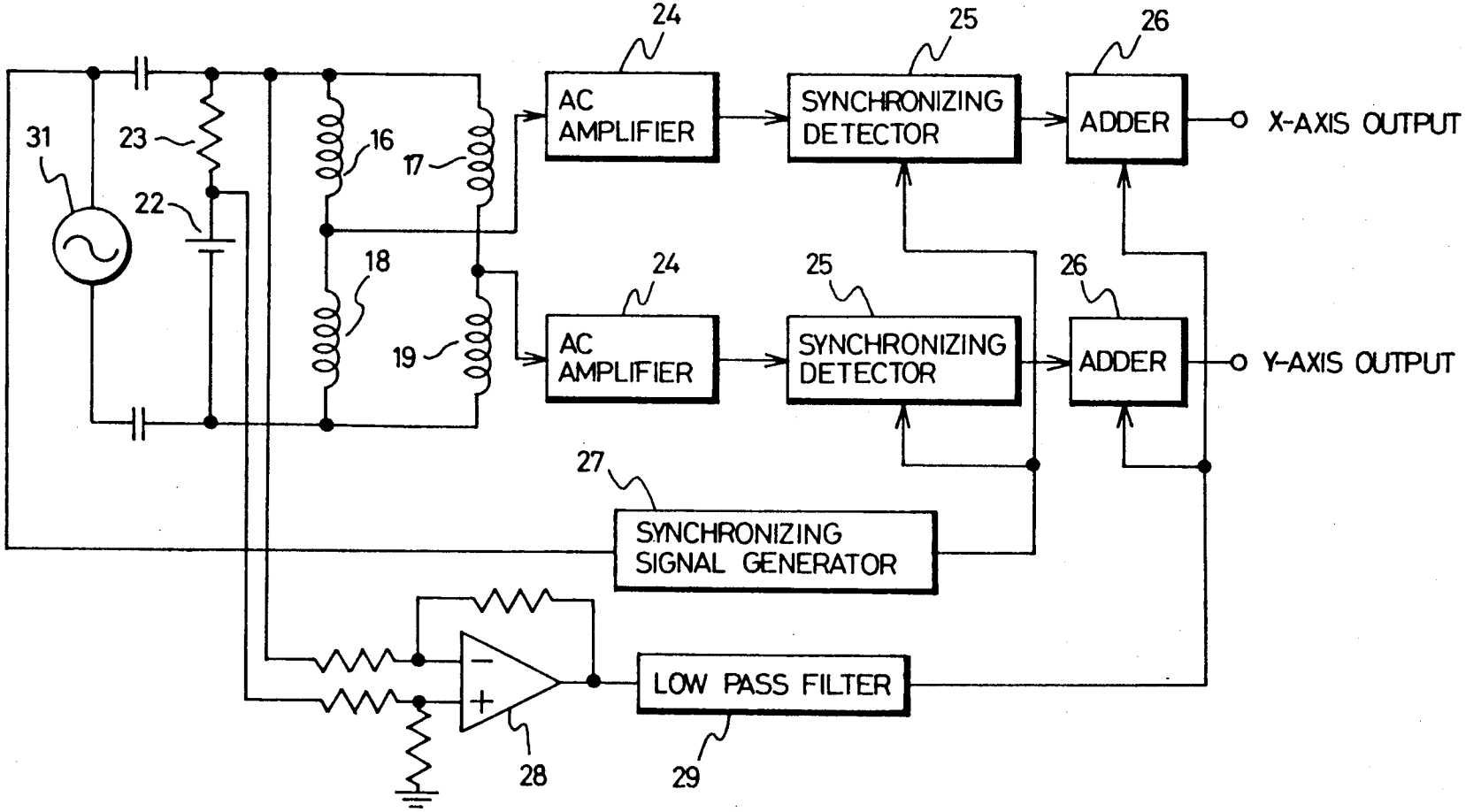
FIG. 4 is a block diagram of a detecting and temperature-compensating circuit for the deflection sensors.

FIG. 4 shows an embodiment of signal detecting function and signal temperature-compensation function for the sensors 16–19. In FIG. 4, a sine wave oscillator 31 generates an alternative current which flows through the coils of the sensors 16–19 thereby exciting the iron cores thereof, the normal direction sensors 16 and 18 detect a change in inductance caused by a displacement (deflection) of the end portion 12*a* of the spindle 12 in the direction X (the normal direction or the cutting direction), and output a signal voltage to an alternative current amplifier 24. The output voltage from the sensors 16 and 18 is amplified by the alternative current amplifier 24, and full-wave rectification of the signal in the direction X is carried out by a synchronizing detector 25. A synchronizing signal generator 27, which produces a synchronizing signal corresponding to the phase of the alternative current generated by the sine wave oscillator 31, outputs a synchronizing signal to the synchronizing detector 25. And then, an output signal voltage from the synchronizing detector 25 is inputted into an adder 26.

Further, in the circuit in the same figure, a direct current power source 22 is provided in parallel with the sensors 16 and 18, and 17 and 19, and a reference resistor 23 is provided in series with the direct current power source 22. The direct current power source 22 and the reference resistor 23 are used for detecting pure resistance of the coils of the sensors 16–19. Both terminals of the reference resistor 23 are connected to a pure resistance detector 28. The pure resistance detector 28 detects, based on a change in voltage, between the two terminals of the reference resistors 23, a change in pure resistance of the coils of the sensors 16–19 caused by a thermal change.

Figure 5:
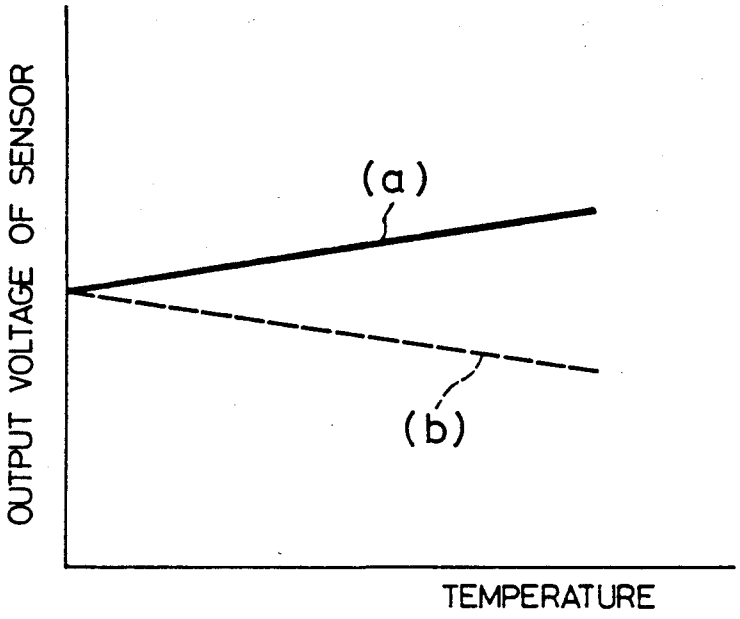
FIG. 5 and FIG. 6 are diagrams showing the relationship between the output voltage from the sensors and temperature.

Namely, since a voltage from the direct current power source 22 is constant, the pure resistance of the coils of the sensors 16, etc. increases with the rise of temperature, and the voltage between the two terminals of the reference resistor 23 falls with the rise of temperature as shown by a graph (b) in FIG. 5. As a result, the pure resistance detector 28 outputs a signal voltage corresponding to the changed amount of the fall of voltage caused by the decrease of the pure resistance value, then a signal component, outputted from the oscillator, in the signal voltage is cut by a low-pass filter 29, and the signal is inputted into the adders 26. The direct current power source 22, reference resistor 23, pure resistance detector 28, low-pass filter 29 and adders 26 form signal error compensation means.

An output voltage from the synchronizing detector 25 to be inputted into the adders 26 has a drift as shown by the graph (a) in FIG. 5 when the temperature of the sensors 16, etc. rise notwithstanding the deflection of the spindle 12 remains the same, and consequently an output signal value has an error caused by the thermal change.

Figure 6:
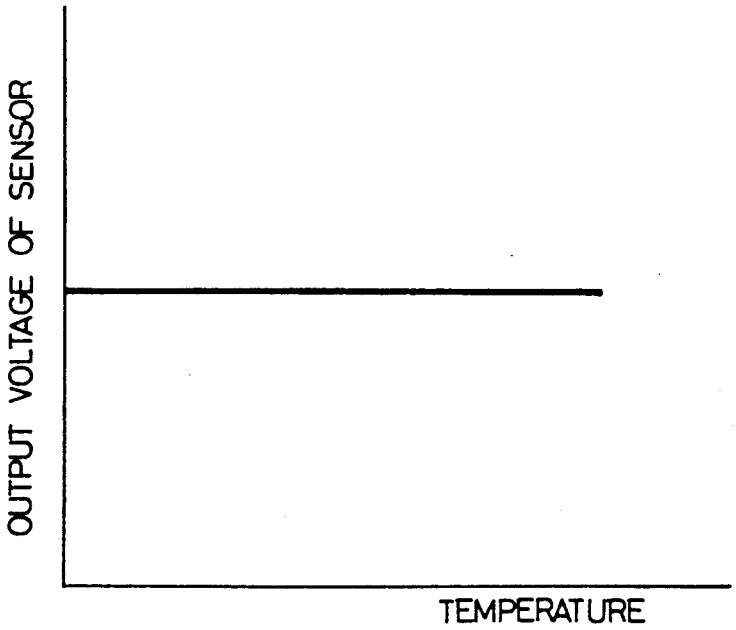

Therefore a signal voltage from the low-pass filter 29 (as shown by the graph (b) in FIG. 5) is added to a signal from the synchronizing detector 25 in order to compensate the error, whereby the adder 26 outputs a signal having no thermal influence, as shown in FIG. 6, and a constantly accurate information is provided to realize correct adjustment of the machining condition.

In the above embodiment, the direction X in FIG. 5 is the cutting direction, and the normal direction sensors 16 and 18 detect a deflection amount $\delta$ for control. However, it is also possible that the direction Y is placed in the cutting direction, and in this case the sensors 17 and 19 detect a deflection amount, and the control is carried out by a Y-axis motor.

According to the present invention, based on a deflection of the grinding shaft detected during grinding work, the feed of the grinder is controlled, and the sharpness of the grinder is determined based on changes of the detected deflection amount during spark-out, moreover an error in the signal from the deflection detector caused by a thermal change can be compensated, whereby grinding work is carried out under an optimum condition, and the grinding accuracy and efficiency are improved.

What is claimed is:

1. An apparatus for controlling a grinder having a grinder having a spindle with deflection sensor means comprising:

a motor;

a grinding shaft driven by said motor;

a grinding wheel mounted at an end portion of said grinding shaft for grinding a workpiece;

feeding means for feeding the grinding wheel relative to the workpiece during a machining operation;

deflection sensor means a part of which is disposed on the end portion of said grinding shaft for sensing a deflection of the end portion of said grinding shaft in terms of a change in inductance caused by the deflection during a machining operation and producing output signals representative of the amount of deflection; and control means for controlling a feeding amount of said grinding wheel toward the workpiece in response to the output signals of said deflection sensor means.

2. An apparatus according to claim 1; wherein said grinding shaft has cylindrical target means fixed around the outer peripheral surface of the end portion of said grinding shaft and disposed so as to be separated by a gap from said deflection sensor means.

3. An apparatus according to claim 1; wherein said control means comprises sizing means for measuring a size of the workpiece under machining and producing a corresponding output signal; a main controller for generating a feed signal corresponding to a feed amount of said grinding wheel in response to the output signals of said sizing means and said deflection sensor means; a feed controller for outputting a driving signal in response to said feed signal; and a servo motor for feeding said grinding wheel in response to said driving signal.

4. An apparatus according to claim 3; wherein said control means further comprises temperature sensing means disposed adjacent to said deflection sensor means for sensing a change in temperature of said deflection sensor means and producing a corresponding temperature signal; temperature converting means connected to receive the temperature signal from said temperature sensing means for generating a temperature-compensation signal representative of a temperature-compensated deflection; and signal adjusting means receptive of said output signals from said deflection sensor means and said temperature-compensation signal for computing and outputting said feed signal which is independent of thermal influence.

5. A method for controlling a grinder having a spindle with deflection sensor means comprising the steps of:

(a) rough grinding a workpiece by feeding a grinding wheel in such a condition that a deflection at an end portion of a grinding shaft caused by a grinding force is at a first predetermined constant value $\delta_{GR}$, until the workpiece has a first predetermined size;

(b) rough grinding the workpiece during spark-out without feeding the grinding wheel until said deflection is reduced to a second predetermined value $\delta_{GSP}$;

(c) fine grinding the workpiece by feeding the grinding wheel in such a condition that said deflection is at a third predetermined constant value $\delta_F$ which is less than the first predetermined value $\delta_{GR}$, until the workpiece has a second predetermined size;

(d) fine grinding the workpiece during spark-out without feeding the grinding wheel;

(e) measuring an elapsed time $T_F$ between said deflection from the third predetermined value $\delta_F$ to a fourth predetermined value $\delta_{FSP}$; and (f) calculating a time $T_{FSP}$ required for fine grinding the workpiece during spark-out from the elapsed time $T_F$, the third predetermined value $\delta_F$ and the fourth predetermined value $\delta_{FSP}$.

6. A method according to claim 5; wherein the measuring step (e) further comprises the steps of:

(e1) comparing the elapsed time $T_F$ with a predetermined time value, and (e2) dressing the grinding wheel after fine grinding during spark-out when the elapsed time $T_F$ is larger than the predetermined time value.

7. An apparatus for performing a machining operation on a workpiece comprising: a rotationally driven tool shaft having means for releasably holding a tool; controllable feeding means for feeding the tool relative to the workpiece to carry out a machining operation accompanied by deflection of the tool shaft from a reference position; deflection sensing means for sensing the amount of deflection of the tool shaft in terms of a change in inductance caused by the deflection and producing an output signal representative of the deflection amount; and control means responsive to the output signal for controlling the feeding means to control the feeding of the tool relative to the workpiece in accordance with the output signal.

8. An apparatus according to claim 7; wherein the control means includes means responsive to the output signal for controlling the feeding speed of the tool relative to the workpiece.

9. An apparatus according to claim 7; wherein the deflection sensing means comprises a plurality of iron cores disposed circumferentially around the tool shaft and radially spaced therefrom to define a gap between each iron core and the tool shaft, circuit means including a wire wound around each iron core for flowing a current through the wires to excite the iron cores, means on the tool shaft at a location confronting the iron cores for changing the inductance of the circuit means in dependence of the deflection amount of the tool shaft, and means for measuring the inductance change and producing the output signal.

10. An apparatus according to claim 9; wherein the means on the tool shaft comprises a cylindrical target.

11. An apparatus according to claim 9; including temperature-compensating means for temperature-compensating the output signal.

* * * * *